United States Patent [19]

Chang

[11] Patent Number: 4,555,088

[45] Date of Patent: Nov. 26, 1985

[54] ARCHITECTURAL CONSTRUCTION AND EQUIPMENT FOR CONCRETE

[76] Inventor: Shih-Chieh Chang, 29-10, Ta-Pun Rd., Taichung, Taiwan

[21] Appl. No.: 653,487

[22] Filed: Sep. 24, 1984

Related U.S. Application Data

[62] Division of Ser. No. 530,606, Sep. 9, 1983, abandoned.

[51] Int. Cl.[4] ..... B28B 7/28

[52] U.S. Cl. ..... 249/192; 249/189; 249/194; 249/196; 249/29

[58] Field of Search ..... 249/47, 188, 189, 192, 249/194, 196

[56] References Cited

U.S. PATENT DOCUMENTS

| | | | |
|---|---|---|---|
| 967,836 | 8/1910 | Rodham | 249/192 X |
| 1,123,261 | 1/1915 | Edison | 249/192 X |
| 1,643,712 | 9/1927 | Henson | 249/192 |
| 2,017,553 | 10/1935 | Troiel | 249/47 X |
| 2,871,619 | 2/1959 | Walters | 249/192 X |
| 2,939,198 | 6/1960 | Nicholls | 249/47 |
| 2,953,835 | 9/1960 | Armstrong et al. | 249/188 |
| 2,991,532 | 7/1961 | Stiles | 249/188 |
| 3,123,887 | 3/1964 | Boettner | 249/192 |
| 3,171,185 | 3/1965 | Anderson | 249/47 X |
| 3,288,427 | 11/1966 | Pluckebaum | 249/192 |
| 3,307,822 | 3/1967 | Stout | 249/189 |
| 3,357,673 | 12/1967 | Williams | 249/194 |
| 3,381,929 | 5/1968 | Baucker | 249/189 X |
| 3,468,988 | 9/1969 | Williams | 264/31 |
| 3,771,769 | 11/1973 | Niemi et al. | 425/432 |
| 3,782,680 | 1/1974 | Hopkins | 249/188 |
| 4,407,480 | 10/1983 | Trimmer et al. | 249/189 |

FOREIGN PATENT DOCUMENTS

| | | | |
|---|---|---|---|
| 612465 | 11/1960 | Italy | 249/47 |

*Primary Examiner*—J. Howard Flint, Jr.

[57] ABSTRACT

A reusable panel system for making concrete form structures, especially, after concrete is hardened, forms are dismantled and construction is finished, various patterns or designs will be left on the ceiling and beam, and these patterns or designs are uniform, smooth and delicate, therefore, they could save labor and material and make building have a nice appearance.

3 Claims, 14 Drawing Figures

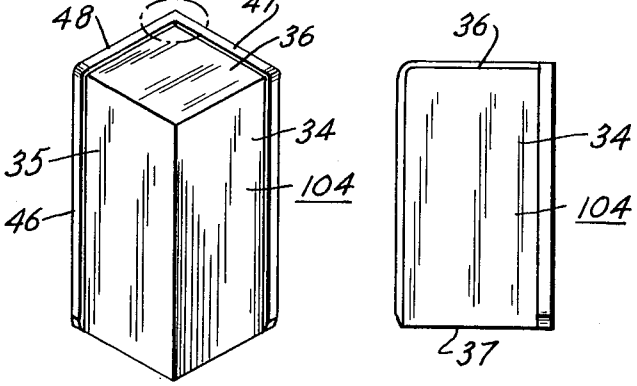
FIG. 8
FIG. 7
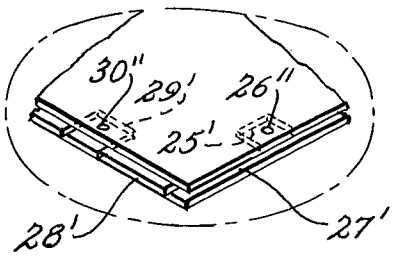
FIG. 12
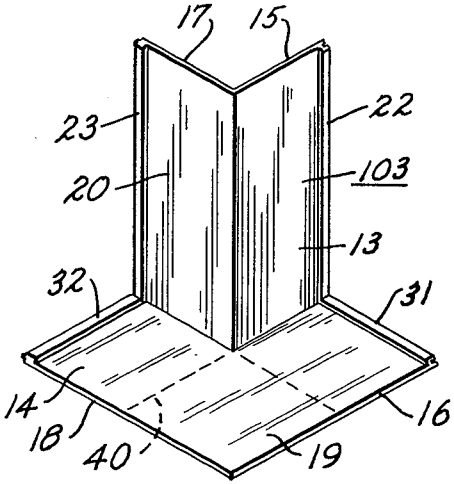
FIG. 5
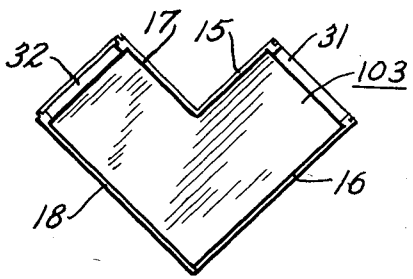
FIG. 6

ARCHITECTURAL CONSTRUCTION AND EQUIPMENT FOR CONCRETE

This application is a division of my copending application Ser. No. 530,606, filed Sept. 9, 1983, now abandoned.

BACKGROUND OF THE INVENTION

1. Field of the Invention

The present invention relates to a reusable panel system. Especially, after the concrete is hardened, the forms are taken off, and the construction is finished, various patterns or designs will be left on the ceiling and beam, and these patterns or designs are uniform, smooth and delicate.

2. Background of the Prior Art

According to the conventional architectural method, for example, most apartment houses are built by planking wooden forms and these forms are placed to form a hollow cavity at the pre-position of beam and column, and after piping water pipe and electrical wire tube in the hollow cavity, concrete is placed directly on all forms. The grouting cement or water will leak from slits because the surface of forms are uneven and have slits, and after the concrete is hardened and the forms are dismantled, there is still a need for time and labor to trowel, float and broom the uneven and rough surface of the ceiling and beam. Furthermore, if patterns or designs of anaglyph are required to be embossed purposely on the surface of ceiling or beam, the work is very difficult and material used for attaching on the surface of ceiling or beam to form patterns or designs of anaglyph will fall off because of gravitation and make the building not refined to look at.

SUMMARY OF THE INVENTION

The purpose of the present invention is to provide a reusable panel system for making concrete form structures. After concrete is hardened and forms are dismantled, various pre-designed patterns or designs will be left on the surface of the ceiling and beam after using the construction and equipment of the present invention which will make the surface of said patterns and designs be smooth and delicate and need not be trowelled, floated and broomed.

Briefly speaking, the present invention still used the conventional construction to plank wooden forms, and then placed the unique plastic panels of the invention on the wooden forms and sprayed water on the plastic panels and grouted concrete in it. After the concrete is has hardened and the forms and plastic panels are taken off, a smooth, delicate and uniform surface of the pre-designed anaglyph is left on the surface of the ceiling and beam.

BRIEF DESCRIPTION OF THE DRAWINGS

FIG. 5 is a perspective view of the third basic panel.

FIG. 6 is a side, elevational view of FIG. 5.

FIG. 7 is a perspective view of the fourth basic panel.

FIG. 8 is a side, elevational view of FIG. 7.

FIG. 12 is an enlarged perspective view of "c" part of FIG. 7.

DETAILED DESCRIPTION OF THE PREFERRED EMBODIMENT

Figures 1, 2, 3, 4, 10, 11:
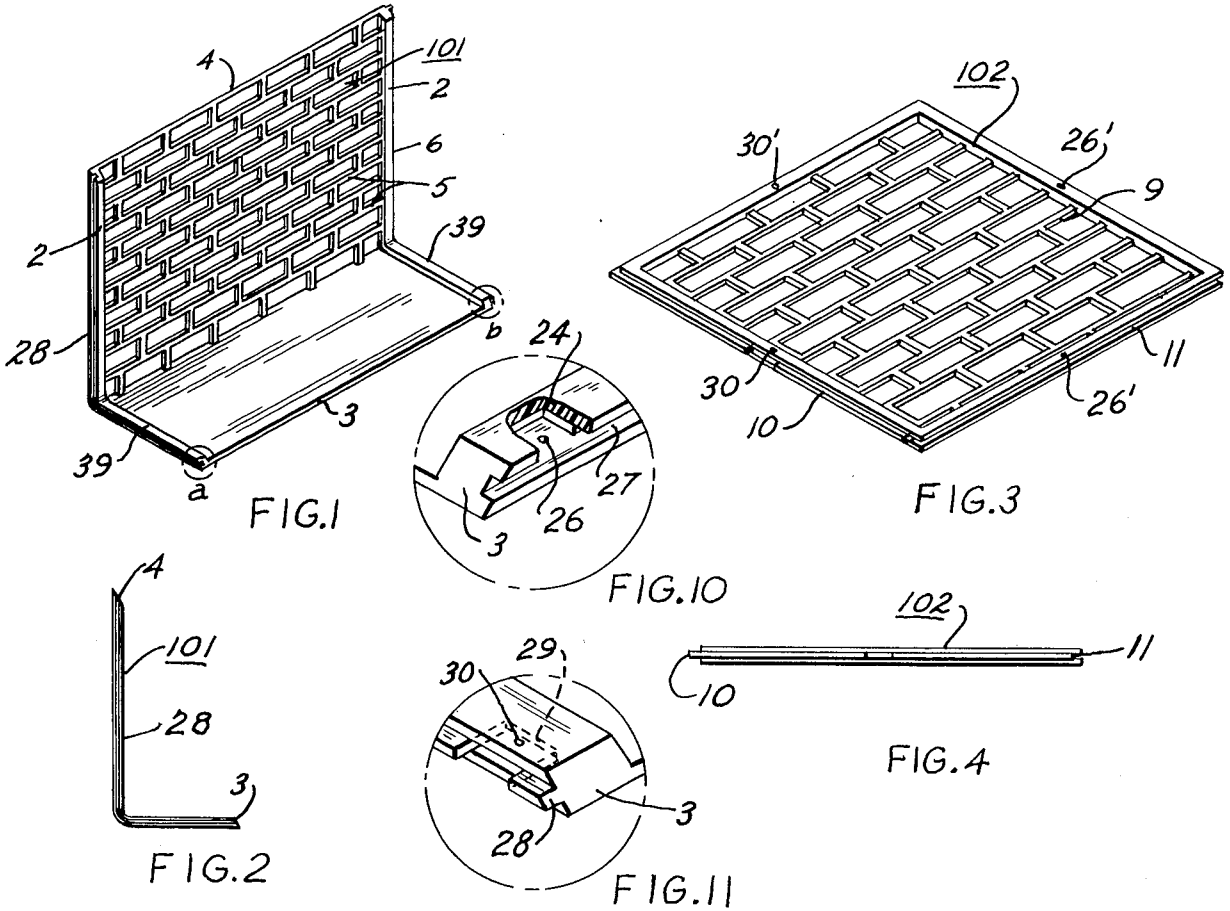
FIG. 1 is a perspective view of the first basic panel.
FIG. 2 is a side elevational view of FIG. 1.
FIG. 3 is a perspective view of the second basic panel.
FIG. 4 is a side, elevational view of FIG. 3.
FIG. 10 is an enlarged perspective view of "b" part of FIG. 1 showing the right margin outside of the horizontal of the first basic panel.
FIG. 11 is an enlarged perspective view of "a" part of FIG. 1 showing the left margin outside of the horizontal of the first basic panel.
Figures 9, 13, 14:
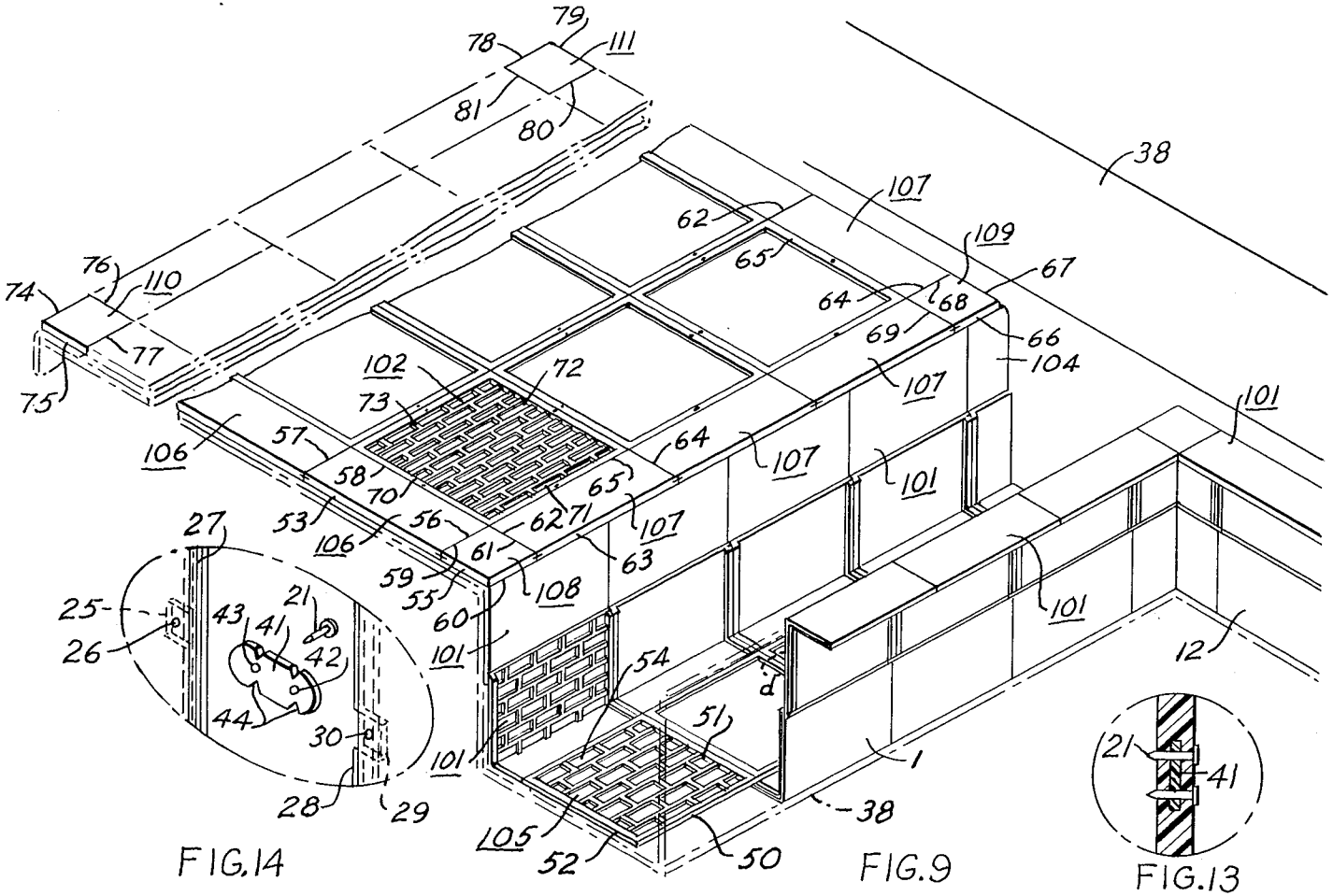
FIG. 9 shows the construction and the perspective view of the system of the present invention.
FIG. 13 is a vertical sectional view of "d" part of FIG. 9 showing the connection of two adjacent basic panels.
FIG. 14 is a perspective segmental view of FIG. 13.

The system of the present invention mainly includes eleven kinds of basic panels, wherein structure of the fifth basic panels to the eleventh basic panel are similar to the structure of the second basic panel, therefore, their perspective and side, elevational views are not shown in figures respectively and they are only shown in FIG. 9. In the system of the invention, the first basic block 101 is shown in FIGS. 1 and 2, the second basic panel 102 is shown in FIGS. 3 and 4, the third basic block is shown in FIGS. 5 and 6, the fourth basic panel 104 is shown in FIGS. 7 and 8, wherein, the first basic panel 101 possesses a vertical sheet 6 and a horizontal sheet 7, at two sides of vertical sheet 6, there are reinforce ribs 2 (These reinforce ribs are made thicker to meet the requirement of connecting neighbored basic panels, other kind of basic panel also has this kind of reinforce rib.), at two sides of horizontal sheet 7, there have reinforce rib 39; inner side surface of vertical sheet 6 partially or wholly has patterns (or designs) 5, and the outside surface is smooth. At the upper side of vertical sheet 6 and front side of horizontal sheet 7, there are edges 4 and 3 individually. (In other words, the body of vertical sheet and horizontal sheet are slightly thick, from the boundary line between body of vertical and horizontal sheets and edges 4 and 3, the thickness of vertical and horizontal sheets' body is reduced and to the side margin line, it is the thinnest.). At the left side of reinforce ribs 2 and 39, there are tongues as shown in FIG. 11, wherein a recess 29 is near edge 3, and its height is the same as the thickness of the tongue 28, at the reinforce rib 39 near the upper and the lower part of recess 29, a small hole 20 is drilled there. At the other side, there is a groove 27 at the right side of reinforce rib, as shown in FIG. 10, and a recess 25 is near edge 3 (In FIG. 10, a small block 24 is removed so that it can be seen clearly), its height is as same as the height of groove 27, and small hole 26 is drilled at the reinforce rib 39 near the upper and the lower part of recesc 25. Referring to FIG. 14, at outer margin of a connector 41, there are four cracks 44, and small holes 42 and 43 are drilled on the vertical central line. One end of the connector 41 near small hole 42 is inserted into the recess 29, the other end near small hole 43 is inserted into the recess 25, and the tongue 28 is inlaid in the groove 27, and after the small holes 30 and 26 are precisely faced to the small holes 42 and 43, pins 21 are inserted respectively in order to prevent the tongue 28 from separating from the groove 27, it also prevents the relative transfer from happening between two adjacent first basic panel 101. After assemblage, its vertical exploded view is shown in FIG. 13. Another two adjacent basic panels which are the same type or different types also use the above-mentioned method to prevent the relative movement between them.

Please next refer to FIGS, 3 and 4, at the surface of the second basic panel 102, patterns or designs 9 are designed there, and its back is a smooth plane. In the outside of the second basic panel 102, the adjacent two sides have a groove 11, another adjacent two sides have a tongue 10. On the reinforce rib of the central position of the groove 11, small hole 26' is drilled there and small hole 30' is drilled at the central position of the tongue 10, as shown in FIG. 14, and at the position of small hole 26' and 30', recesses are formed there are these two recesses are connected by the connecting sheet and thus two adjacent basic panels will not move relatively.

Please refer to FIGS. 5 and 6. The third basic panel 103 has a pair of vertical sheets 13 and 20 and a pair of horizontal sheets 19 and 14. Vertical sheets 13 and 20 respectively possess reinforce ribs 22 and 23 and edges 15 and 17, horizontal sheets 19 and 14 respectively possess reinforce ribs 31 and 32 and edges 16 and 18. Left side reinforce ribs 23 and 32 have tongue, and right side reinforce ribs 22 and 31 have groove, the others, i.e. recess, small hole, extruded margin and groove, the connection of them is as same as the above-mentioned and shown in FIGS. 10, 11, 13 and 14, therefore it is not described herein again.

Please refer to FIGS. 7 and 8, the fourth basic panel 104 has a pair of adjacent vertical sheets 34 and 35 and the horizontal sheet 36 for connecting two vertical sheets 34 and 35; horizontal sheet 36 has a pair of reinforce ribs 47 and 48, vertical sheets 34 and 35 respectively have reinforce ribs 45 and 46. Near the lower end of reinforce ribs 45 and 46 its structure is same as shown in FIGS. 10 and 11. Structure near the connection place of reinforce ribs 47 and 48 shown in FIG. 12 respectively has a tongue 28' and groove 27' and at the tongue 28', there also have a recess 29' and small hole 30'', in groove 27' a recess 25' and a small hole 26'' are also formed therein. At the lower margin of vertical sheets 34 and 35, there is edge 37 too.

As shown in FIG. 9, the fifth basic panel 105 and the second basic panel 102 are almost same, and only side 52 has a tongue, and side 51 has groove, sides 50 and 54 have edges. The area of the sixth basic panel 106 is about the half of the second basic panel 102, and only side 53 has edge, side 57 has a tongue, sides 56 and 58 have grooves. The area of the seventh basic panel 107 is as same as the sixth basic panel 106, and only side 63 has edge, sides 62 and 65 have tongue, side 64 has groove. The individual area of the eighth basic panel 108 to the eleventh basic panel 111 is about the half of the sixth basic panel 106, and only the sides 55 and 60 of the eighth basic panel 108 have edges, side 59 has tongue, side 61 has groove; sides 66 and 67 of the ninth basic panel 109 have edges, sides 69 and 68 have tongue; sides 74 and 75 of the tenth basic panel 110 have edges, sides 77 and 76 have grooves; sides 78 and 79 of the eleventh basic panel 111 have edges, side 80 has groove; side 81 has tongue, sides 70 and 73 of the second basic panel 102 have tongue, sides 71 and 72 have grooves.

Referring to FIG. 9 construction of the present invention is as follows: Firstly, according to the conventional method, wooden forms 38 are planked (as indicated by dotted line), and then the upper row of the first basic panels 101 are placed at the pre-position of beam and the lower row of the first basic panels 101 are next placed, and then a row of the fifth basic panels 105 are placed too. At the upper side of the corner, the fourth basic panel 104 is placed there and the third basic panel 103 is placed at the lower side of the corner.

For the next one, on the horizontal sheet of the above mentioned row of the first basic panels 101, the eighth basic panel 108, the ninth basic panel 109 and a row of the seventh basic panel 107 are designed, as shown in figure, all basic panel are placed wherein the eighth basic panel 108 to the eleventh basic panel 111 are placed at the four corners of the ceiling. And then on the above-mentioned each basic block, a layer of form-remove agent of concrete is sprayed there, and reinforcement bars and water pipe, electrical wire tube are assembled on the architectural position of each basic panel (if the horizontal sheet of the basic panel 103 blocks reinforcement bar, and it can be partly cut along the dotted line 40), and spray a thin layer of water on each basic panel, and grout concrete in the pre-position of beam and ceiling. And after concrete is dried, and forms are dismantled the products are completed. The procedure of dismantling forms is firstly to take off the wooden forms 38, and then dismantle the plastic mould of the invention and when wooden forms are taken off, plastic moulds are fallen down too, therefore, the plastic mould of the invention is easy be take off.

As mentioned in the above, before grouting concrete, form-remove agent and water are sprayed on the form, and form-remove agent is used for facilitating removing of the form and water is used to remove form and let the surface of the product more smooth and delicate (Cement power will be left on the lowest surface, it is the testing result of the invention for many times.). If user wants the beam of the product more delicate and smooth, vibrator can be used to vibrate the reinforcement position after grouting concrete and can make concrete spread in average and have more perfect surface.

After dismantling the mould, the function of crack 44 of the connecting sheet 41 is to clean the concrete with flows into recesses 29 and 25. The above-mentioned basic panel can each be formed integrally and is easy to be made and can each be used many times. Plastic can be selected as material of mould because it is durable, flexible and heat-resistance. To facilitate dismantling, the third basic panel 103 and the fourth basic panel 104 near geometric center can be made thinner and flexible. There will produce outside tension after grouting concrete, therefore, the angle between vertical sheet 6 and horizontal sheet 7 of the first basic panel 101 will be bigger than 90° (i.e. 92°), and after grouting concrete, the angle will be pushed and pressed as 90°. The outter surface of the third basic block 103 and the fourth basic panel 104 are smooth and have no pattern or design for taking off easily. The above-mentioned patterns are similar to the patterns on the casting mould, the patterns of the product are corresponding to the patterns of the casting mould (i.e. the concave part of the casting mould is just the convex part of the product). In construction, several adjacent basic panels can be connected together at the site for transporting mould and then transport the mould to the construction site. The mould of the present invention can be used many times and if there is any damage after being used many times, the material of the used mould can be remade, therefore, its cost is very low.

The pre-set position of beam as shown in FIG. 9 is wider, and two or more rows of the fifth basic panels 105 can be placed on the pre-set position of beam, therefore, the present invention is suitable for more wider beam.

The above-mentioned sixth basic panel 106 to the eleventh basic block 111 also possess pattern surface with a nice apparance.

In the figures, there is only one kind of pattern or design, but in practice, each basic block can possess the same or different patterns or designs and use several different designs or patterns together.

If the length of the beam is not just the integral times of the fifth basic panel 105, the last one or the front and rear panel of the fifth basic panel 105 will be cut partially. And if length or width of the ceiling is not just the integral times of the second basic panel 102, the sixth basic panel 106 to the eleventh basic panel 111 will partly cover the vertical sheet of the upper row of the first basic panel 101 and will not cover completely each other, and they covered completely by each other as shown in FIG. 9.

I claim:

1. A reusable panel system for making concrete form structures comprising at least two adjacent panels, each of said panels having a facing for shaping the concrete material thereagainst and a one-piece extruded rib on two opposite side edges of the panel joined with said facing, one of the two ribs having a tongue projecting toward the adjacent panel and extending substantially the full length of the rib, the other rib having a groove therein extending substantially the full length of said other rib and extending into said rib from the direction of the adjacent panel whereby the tongue of one panel extends into the groove of the second panel when said panels are positioned adjacent and abutting each other, said tongues and said grooves each having at least two recesses extending thereinto in the plane of the panels and into said ribs, a connector for each pair of adjoining recesses in said ribs inserted into said panel recesses, each panel and each end of each connector having holes in alignment for reception of a pin in said aligned holes for maintaining said connectors in said recesses and for maintaining adjacent panels connected to each other.

2. A panel system according to claim 1 in which the panels are made of plastic and are formed by extrusion on a one-piece panel.

3. A panel system according to claim 1 in which the panels are formed with patterns on at least one of the faces thereof.

* * * * *